US008505129B2

(12) United States Patent
Parker et al.

(10) Patent No.: US 8,505,129 B2
(45) Date of Patent: Aug. 13, 2013

(54) ROD WITH TWIST-END TENSION ASSEMBLY

(75) Inventors: Maurice Stafford Parker, Kinston, NC (US); Willie Strong, Goldsboro, NC (US); Melvin Walker, Jr., Goldsboro, NC (US); Stephen Blair Brooks, Clemmons, NC (US)

(73) Assignee: Ex-Cell Home Fashions, Inc., New York, NY (US)

( * ) Notice: Subject to any disclaimer, the term of this patent is extended or adjusted under 35 U.S.C. 154(b) by 81 days.

(21) Appl. No.: 13/294,491

(22) Filed: Nov. 11, 2011

(65) Prior Publication Data

US 2013/0117926 A1 May 16, 2013

(51) Int. Cl.
*A47K 3/22* (2006.01)

(52) U.S. Cl.
USPC ..... 4/610; 211/105.1; 211/123; 248/200.1

(58) Field of Classification Search
USPC ..... 4/557, 607, 610; 211/105.1, 123; 248/200.1
See application file for complete search history.

(56) References Cited

U.S. PATENT DOCUMENTS

| | | | |
|---|---|---|---|
| 727,454 | A | 5/1903 | Royce |
| 2,199,851 | A | 5/1940 | Culver |
| 2,492,517 | A | 12/1949 | Bernick |
| 2,974,806 | A | 3/1961 | Seewack |
| 3,333,808 | A | 8/1967 | Du Boff |
| 3,493,121 | A | 2/1970 | Doyle |
| 3,838,928 | A | 10/1974 | Blaurock et al. |
| 3,951,269 | A | 4/1976 | Anderson |
| 4,586,616 | A | 5/1986 | Cooper et al. |
| 4,636,106 | A | 1/1987 | Waisbrod |
| 4,981,390 | A | 1/1991 | Cramer, Jr. et al. |
| 5,022,104 | A | 6/1991 | Miller |
| 5,433,551 | A | 7/1995 | Gordon |
| 5,492,429 | A | 2/1996 | Hodges |
| 5,702,010 | A | 12/1997 | Liang |
| 5,826,847 | A | 10/1998 | Warner et al. |
| 6,543,629 | B1 | 4/2003 | Samelson |
| 6,694,543 | B2 | 2/2004 | Moore |
| 6,824,000 | B2 | 11/2004 | Samelson |
| 6,845,955 | B1 | 1/2005 | Hsu |
| 7,124,451 | B2 | 10/2006 | Moore |
| 7,211,001 | B2 | 5/2007 | Motyka et al. |
| 7,857,151 | B2 | 12/2010 | Barrese |
| 7,926,127 | B2 | 4/2011 | Barrese |
| 2002/0148796 | A1 | 10/2002 | Lin |

FOREIGN PATENT DOCUMENTS

| | | | |
|---|---|---|---|
| GB | 2155325 | A | 9/1985 |
| JP | 402199305 | A | 8/1990 |
| JP | 403092610 | A | 4/1991 |

OTHER PUBLICATIONS

The Free Dictionary, Finial—Definition of Finial, 2003, The American Heritage® Dictionary of the English Language, Fourth Edition copyright © 2000 by Houghton Mifflin Company. Updated in 2009. Published by Houghton Mifflin Company. (http://www.thefreedictionary.com/p/Finial).

*Primary Examiner* — Tuan N Nguyen
(74) *Attorney, Agent, or Firm* — Buchanan Ingersoll & Rooney PC

(57) ABSTRACT

We provide a tension assembly for a curtain rod, preferably a shower curtain rod. The assembly includes a tube and a plunger slidably disposed within the tube. Between the tube and the plunger is a biasing means such as a spring. The plunger includes opposite L-shaped grooves having a common axial section and opposite tangential section. The groove allows inclusion of a locking pin that is retained in the tube. The combination of the locking pin and the L-shaped grooves allows the plunger to be moved until the plunger compresses the spring, then the plunger is locked. When additional the curtain rod is put into place the plunger or rod may be rotated, releasing the plunger and allowing the spring to provide additional tension.

15 Claims, 5 Drawing Sheets

ROD WITH TWIST-END TENSION ASSEMBLY

BACKGROUND OF THE INVENTION

1. Field of the Invention

Embodiments of the invention relate to curtain rods, and in particular, shower curtain rods configured to include a twist end tension assembly and to be easily locked into position.

2. Description of the Related Art

Shower curtain rods are configured to hold a shower curtain and/or shower curtain liner within a shower stall or bathtub to minimize water egress from the shower or bath when a shower head is used. Shower stalls, bathtubs, and other enclosures where a shower curtain rod might be used typically vary in size. Therefore, adjustable shower curtain rods are desirable to accommodate the differently-sized spaces where they may be used. Shower curtain rods may also be used as racks for holding towels, clothes, or other items.

Because of the many support functions of the shower curtain rods, it is important that they be able to be installed to provide adequate support for the shower curtain, shower curtain liner, and/or other items to be supported. Typical tension rods attempt to accommodate this need through the use of a single spring inserted in all or part of the length of the rod that applies force to push the ends of the rod apart. This has a number of disadvantages, including being difficult and time-consuming to configure.

BRIEF SUMMARY OF THE INVENTION

Embodiments of the invention provide a curtain rod, preferably a shower curtain rod, that includes a rod with a quick-adjust tension assembly at one or both ends of the rod. In one embodiment the rod includes a first rod portion extending between a first end and a second end. The first rod portion defines an outer diameter. The embodiment also includes a second rod portion extending between a first end and a second end. The second rod portion defines a first cavity extending within the second rod portion from the first end of the second rod portion. The first cavity has an inner diameter that is larger than the outer diameter defined by the first rod portion, allowing the first rod portion to be received by and slide within the second rod portion.

A tension assembly is disposed within at least one end of one of the rod portions. The tension assembly includes a tube having a cylindrical inner wall, a closed end and an open end. The closed end is disposed toward the first end of the first rod portion and the open end is disposed toward the second end of the first rod portion. The tube also includes engagement means in the inner wall. The engagement means may be, for example, holes or indentations. The tube further includes a protruding lip about the diameter of the open end. This protruding lip has a diameter that is at least as great as the outer diameter defined by the first rod portion.

The tension assembly also includes a plunger. The plunger is slidably disposed within the inner wall of the tube. The plunger includes opposite L-shaped grooves. These grooves, which are made to engage a locking pin, have a common axial section and opposite tangential sections.

The tension assembly also includes a biasing means inside the tube and between the closed end of the tub and the bottom end of the plunger, and a locking pin secured in the engagement means in the inner wall of the tube. The locking pin travels through the L-shaped grooves of the plunger, allowing the plunger to travel laterally in the tube when the locking pin is disposed in the axial section of the L-shaped grooves. The plunger is unable to travel laterally in the tube when the plunger has been rotated to place the locking pin in the opposing tangential sections of the L-shaped grooves.

In a further embodiment the rod assembly includes a foot member coupled to the headed end of the plunger and a foot member coupled to the second end of the second rod portion. Each foot member is configured to engage a corresponding opposing surface.

In a still further embodiment the biasing means is selected from the group consisting of a helical coil spring, a leaf spring, and an elastic cushion. The load-supporting rod assembly may include a spring or other locking or tension-adjusting device in a second cavity between the second rod portion and the first rod portion. In another embodiment the tension assembly is secured in the first cavity by a crimping of the second end of the first rod portion.

In a further embodiment the tension assembly is configured such that rotation of the plunger disengages the locking pin from the opposite tangential sections of the L-shaped grooves and allows expansion of the biasing means.

In a still further embodiment the rod is a single piece. A yet still further embodiment includes only the tension assembly. Further embodiments will be discussed in more detail in the attached figures and specification.

DETAILED DESCRIPTION OF THE FIGURES

Figure 5A:
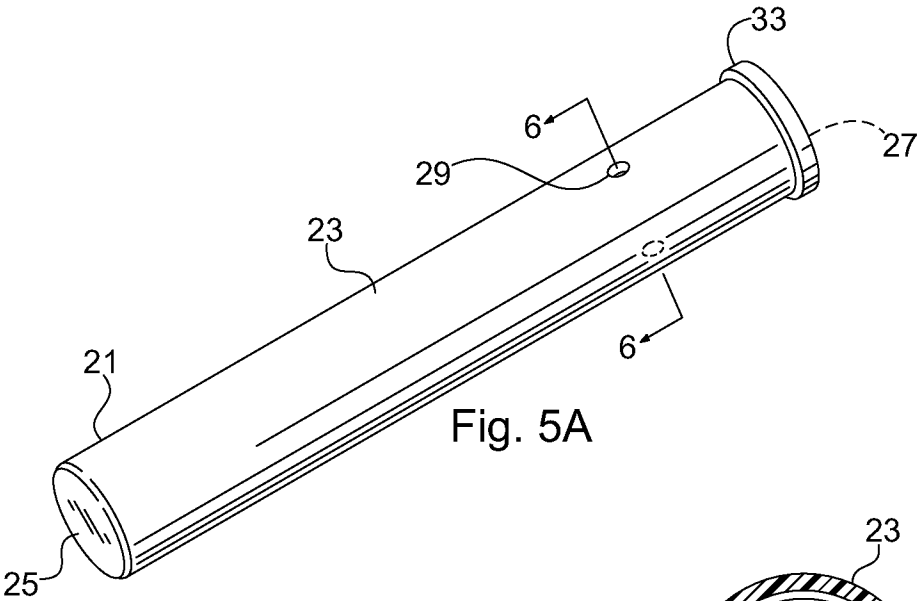
FIG. 5 illustrates a tube used in a tension assembly of the invention.
Figure 5B:
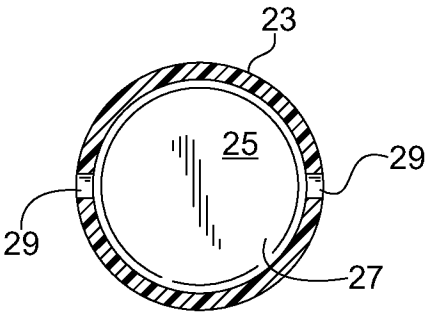

FIG. 5*a* is a perspective view, while FIG. 5*b* is a top cutaway view along the axis of reference number 6.

Figure 6A:
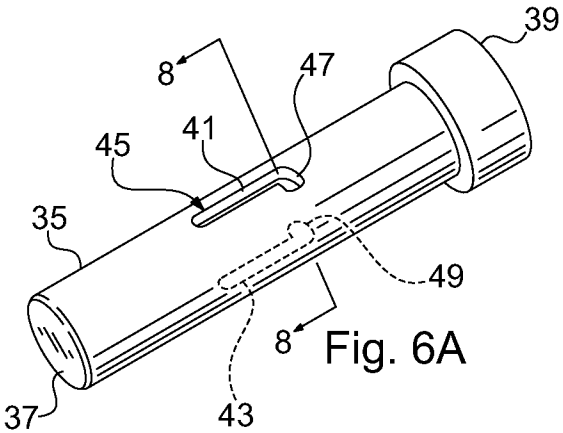

FIG. 6*a* illustrates a plunger used in a tension assembly of the invention.

Figure 6B:
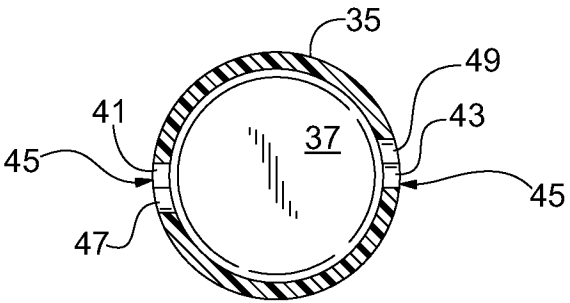

FIG. 6*b* shows a cutaway view along the axis of reference number 8.

DETAILED DESCRIPTION OF THE INVENTION

Embodiments of the invention will now be described more fully with reference to the accompanying drawings. Like numbers refer to like elements throughout the figures.

1. Description of Components

Figure 1:
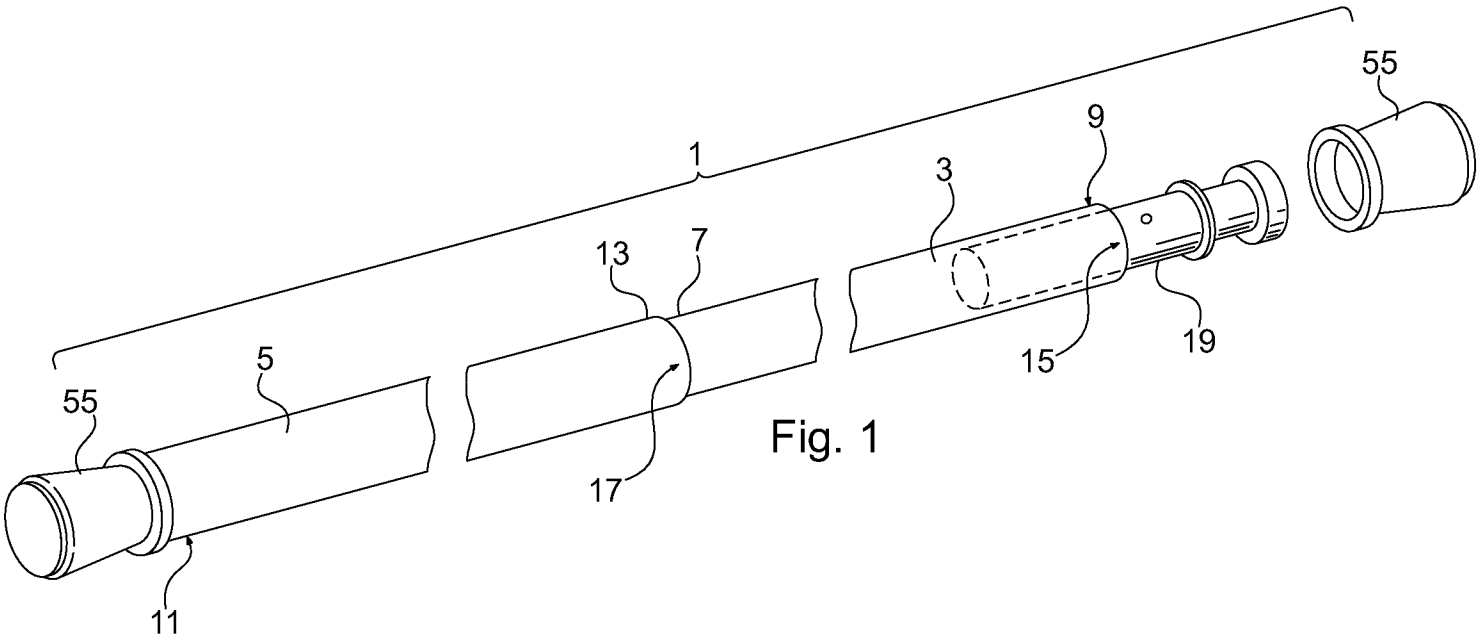
FIG. 1 illustrates a perspective view of a rod assembly according to one embodiment of the invention.

FIG. 1 illustrates a telescoping, load supporting rod assembly according to an embodiment of the invention, with the right side of the figure showing a partially exploded view. The rod assembly 1 includes a first rod portion 3 and a second rod portion 5. The first rod portion has opposing ends 7 and 9, and the second rod portion has opposing ends 11 and 13. The first rod portion rod portion defines a first cavity 15 at end 9. The remainder of the first rod portion may be hollow or solid.

The second rod portion 5 defines a second cavity 17 at the first end 11 of the second rod portion 5. The remainder of the second rod portion may be hollow or solid. The first rod portion may be inserted into the second cavity 5, forming a two-piece rod in which the first section is able to slidably move within the second section. This is accomplished by having all or part of the end of the first rod that inserts into the second cavity 17 have a diameter that is less than the diameter of the second cavity.

Typically a spring (not shown) is inserted into the second cavity prior to insertion of the first rod section. The spring, if present, will provide tension that assists in keeping the assembled rod wedged between two surfaces. In other embodiments the first and second rod sections may be held in a tensioned arrangement by friction (for example, through an interference fit) or by a screw. Other suitable devices for affixing the first rod portion to the second rod portion are disclosed in U.S. patent application Ser. No. 13/222,916, filed on Aug. 31, 2011, for "Quick Lock Tension Rod and Associated Methods." That application is incorporated by reference herein. Although not required, in some embodiments the second rod portion may include a gasket that enhances the fit between the first rod and the second cavity 17, allowing for lower machining tolerances in creation of the rod portions. The gasket may be, for example, plastic.

Figure 2:
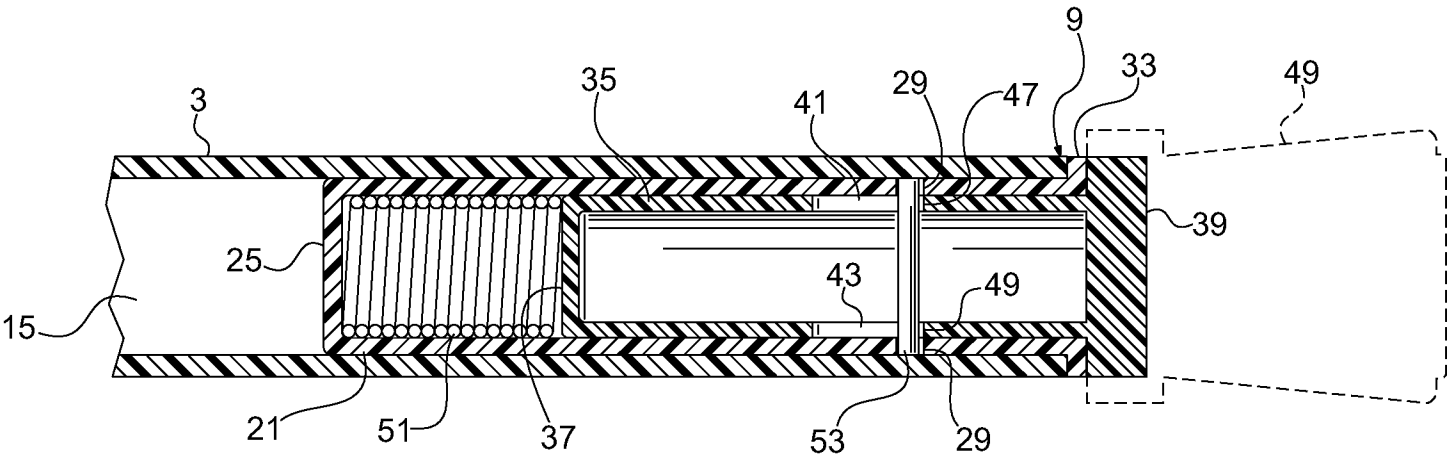
FIG. 2 illustrates a cutaway view of a portion of a rod assembly showing a tension assembly disposed within a cavity in the rod assembly.
Figure 3:
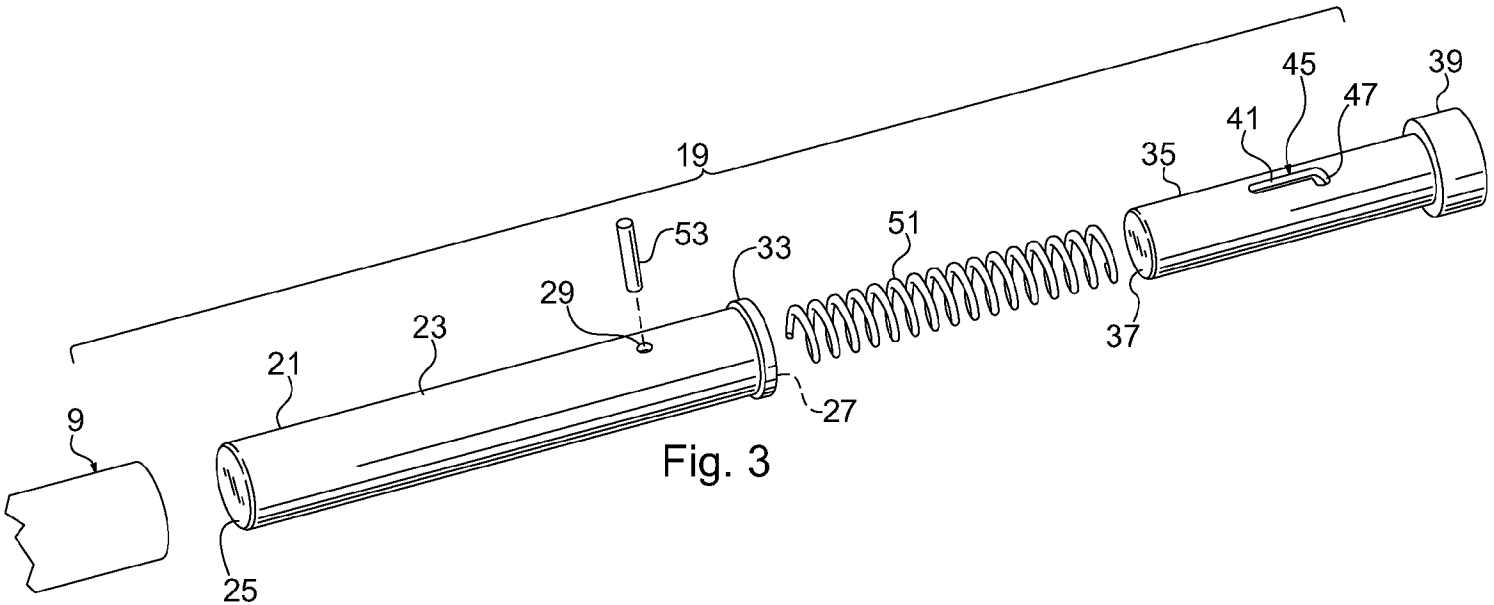
FIG. 3 illustrates an exploded view of a portion of a rod assembly showing a tension assembly of an embodiment of the invention.
Figure 4:
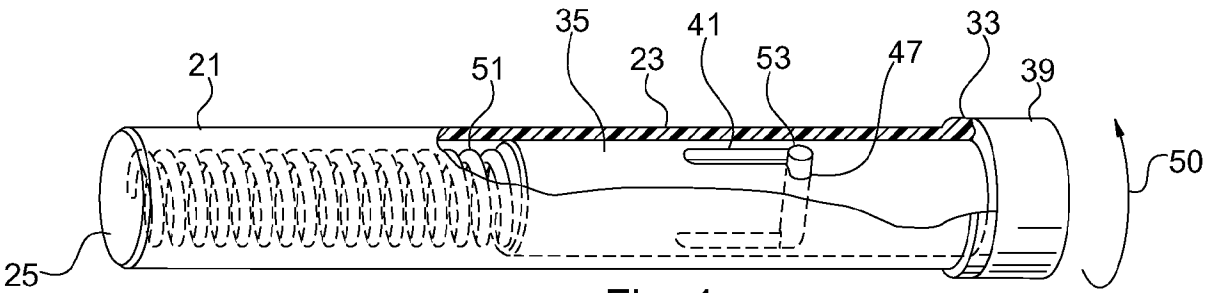
FIG. 4 illustrates a cutaway view of a tension assembly of the invention.

FIG. 2 shows a cutaway view of a tension assembly 19 disposed within the first cavity 15 at end 9. An exploded view of the tension assembly 19 is shown in FIG. 3. The tension assembly comprises or, in some embodiments, consists of, four elements: a tube 21, plunger 35, biasing means 51, and locking pin 53. The tension assembly may be secured in the rod cavity, for example, by crimping of the rod, by welding, or by use of an adhesive. A cutaway view of the tension assembly is shown in FIG. 4

Tube 21 is shown in additional detail in FIG. 5. It includes a cylindrical inner wall 23, a closed end 25, and an open end 27. When the tube is included in a rod the open end is disposed toward the end of the rod meant for engagement with a surface. The tube includes an engagement means for a locking pin 53. Typically the engagement means are holes that travel through opposite sides of the tube; however, they may also be indentations that secure the locking pin, or a hole and an indentation. FIG. 4 shows engagement means 27 and 29 that are holes. Tube 21 further includes a protruding lip 33 about the diameter of the open end 27. This lip allows force to be applied by and to the tension assembly without the tension assembly being undesirably forced further into the cavity in which it is disposed.

Tube 21 is typically made of plastic. However, it may be made of any other material or combination of materials sufficient to withstand the stress that is present when the tension assembly is engaged with a surface and the rod is in use.

Tension assembly 19 further includes plunger 35. Plunger 35 is disposed within the tube so that it may slide along a portion of the length of the tube. Plunger 35 includes a bottom 37 and a headed end 39 that extends outside tube 21.

Headed end 39 may be used to apply force directly to a surface when the tension assembly is engaged with a surface and the rod is in use. More typically, however, the tension assembly is attached to foot member 55. The foot member may be a friction pad, decorative finial, or the like. In some embodiments foot member extends below the headed end and covers protruding lip 33 and headed end 39 from view.

Plunger 35 also includes opposite L-shaped grooves 41 and 43. Grooves 41 and 43 share a common axial section 45, but have opposite tangential sections 47 and 49. Although in some embodiments the angle formed by the axial section and an opposite tangential section is a right angle, in other embodiments the angle may vary so long as the locking function is preserved.

Inside tube 21 and between the bottom 37 of the plunger and closed end 25 of the tube there is a biasing means 51. The biasing means is used to apply force to the tension assembly when it is in an unlocked state. Although a typical biasing means is a helical coil spring, in other embodiments the biasing means may be a leaf spring or an elastic cushion. In a particularly preferred embodiment the biasing means is a 2.5 inch spring that applies 30 pounds of force.

Tension assembly 19 further includes locking pin 53. Locking pin 53 is secured in engagement means 27 and 29 of tube 21 and travels through the L-shaped grooves in plunger 35. As plunger 35 is moved laterally within tube 21, locking pin 53 travels through axial section 45. This is considered to be the "unlocked" state of the tension assembly. In this state the tension assembly will provide tension suitable to keep the rod in place.

If plunger 35 is moved such that locking pin 53 travels through the axial section 45 to the tangential sections of the L-shaped groove, the presence of the locking pin in the tangential sections of the L-shaped groove will allow the plunger to be rotated as shown by reference number 50. Once plunger 35 has been rotated, it is considered to be in a "locked" state. In this state the biasing means is at maximum compression (for the rod) and is not providing tension to assist in keeping the rod in place.

One skilled in the art will appreciate with the benefit of this disclosure that while details of the invention are given relative to an embodiment including a telescoping rod in which the tension assembly is located in a cavity of the rod portion having the lesser diameter of the two rod portions, in other embodiments a tension assembly may be located in a cavity in the rod portion having the greater diameter of the two rod portions. In another embodiment a rod may include two tension assemblies such that one is located in each end of the rod.

In a further embodiment the rod is not a two-piece telescoping rod, but is instead a single-piece rod that includes a tension assembly at one or both ends. Although this embodiment would likely require more careful measurements from the user to ensure that the tension rod will engage opposite surfaces when the tension assembly is engaged, the embodiment may be preferred for reasons of strength or aesthetics.

There is no requirement for the composition of the first and second rod portions. Typically they are made of the same material, though that is not required. Ideally they will be of sufficient strength to withstand long-term and use at tensions that may be achieved by embodiments of the invention. Use of a telescoping rod allows a user to purchase a single rod that may be used in multiple locations without requiring measurements to a high degree of accuracy of the distance to be spanned by the rod.

Although the embodiments that are shown include rods and tubes that appear to be right circular cylinders, one of skill in the art will appreciate that no particular cross-section for the rod is required so long as a first rod portion is able to slidably engage with the second rod portion. Similarly, the outside perimeter of the tube portion of the tension assembly need not be cylindrical, but may instead be made to conform to the interior shape of the rod portion within which it resides. The tension assembly will function so long as the interior of the tube is configured so that the plunger may be rotated to engage and disengage the locking pin.

2. Assembly

With the above information, assembly of a rod with a twist end assembly according to an embodiment of the invention is straightforward. One first places biasing means 51 into tube 21. Plunger 35 is then placed into tube 21 and pressed until axial section 35 and engagement means 29 and 31 are aligned. Locking pin 53 is inserted into engagement means 29, through axial section 35, and into engagement means 31.

Plunger 35 is thereby secured in tube 21, though plunger 35 is allowed to twist and to slidably move within tube 21.

Tube 21 is then inserted into a cavity in the first rod portion up to protruding lip 33 and crimped. Foot member 55 is affixed to headed end 39 of plunger 35. The first rod portion is then combined with second rod portion. Optionally, a spring or other tensioning or locking device is included between the first and second rod portions. Second rod portion may optionally include foot member 55 and/or an additional tensioning assembly.

3. Use

With the advantage of the above information, use of a rod including a tension assembly according to embodiments of the invention is straightforward. The rod end including the tension assembly is placed perpendicular to a surface. Pressure is applied to the rod until the plunger will not move further into the tube. The rod (and therefore also the tube and the locking pin) are twisted, locking the plunger in place. Those of sufficient strength may find that they are able to effect this step by applying force to the plunger with one hand and the rod with the other, then twisting either the rod or the plunger. The tension assembly is that point, in the "locked" position, with the locking pin located in the opposite tangential portion of the L-shaped grooves.

The rod is then put into place by adjusting it to the desired length by sliding the first and second rod portions apart. If a mechanism to lock the first and second rod portions is present, then it is engaged. The plunger is then twisted to disengage the locking pin from the opposite tangential portions of the L-shaped grooves. The locking pin moves to the axial portion of the L-shaped grooves, unlocking the plunger and releasing it to provide a tension fit for the rod.

We claim:

1. A load-supporting rod assembly configured to engage opposing surfaces, the rod assembly comprising:

a first rod portion extending between a first end and a second end, said first rod portion defining an outer diameter;

a second rod portion extending between a first end and a second end, wherein the second rod portion defines a first cavity extending within the second rod portion from the first end of the second rod portion, wherein the first cavity has an inner diameter that is larger than the outer diameter defined by the first rod portion, such that the second rod portion is configured to receive at least a part of the first end of the first rod portion within the second cavity via the first end of the second rod portion; and a tension assembly disposed within at least one cavity selected from the group consisting of a second cavity extending within the first rod portion from the second end of the first rod portion and a third cavity within the second rod extending within the second rod portion from the second end of the second rod portion, said tension assembly comprising a tube having a cylindrical inner wall, a closed end and an open end, wherein the closed end is disposed toward the first end of the first rod portion and the open end is disposed toward the second end of the first rod portion, said tube comprising engagement means in the inner wall and a protruding lip about the diameter of the open end, said protruding lip having a diameter that is at least as great as the outer diameter defined by the first rod portion;

a plunger slidably disposed within the inner wall of the tube, said plunger having a bottom end within the tube and a headed end outside the tube, said plunger having opposite L-shaped grooves having a common axial section and opposite tangential sections;

a biasing means inside the tube and between the closed end of the tub and the bottom end of the plunger;

and a locking pin secured in the engagement means in the inner wall of the tube, said locking pin traveling through the L-shaped grooves of the plunger, wherein the plunger is able to travel laterally in the tube when the locking pin is disposed in the axial section of the L-shaped grooves and unable to travel laterally in the tube when the plunger has been rotated to place the locking pin in the opposing tangential sections of the L-shaped grooves.

2. The load-supporting rod assembly of claim 1, further comprising a foot member coupled to the headed end of the plunger and a foot member coupled to the second end of the second rod portion, wherein each foot member is configured to engage a corresponding opposing surface.

3. The load-supporting rod assembly of claim 1, wherein said biasing means is selected from the group consisting of a helical coil spring, a leaf spring, and an elastic cushion.

4. The load-supporting rod assembly of claim 1, further comprising a spring in the second cavity between the second rod portion and the first rod portion.

5. The load-supporting rod assembly of claim 1, wherein the tension assembly is secured in the first cavity by a crimping of the second end of the first rod portion.

6. The load-supporting rod assembly of claim 1, wherein the tension assembly is configured such that rotation of the plunger disengages the locking pin from the opposite tangential sections of the L-shaped grooves and allows expansion of the biasing means.

7. A tension assembly for a curtain rod, comprising:

a tube having a cylindrical inner wall, a closed end and an open end, said inner wall comprising engagement means and a protruding lip about the diameter of the open end;

a plunger slidably disposed within the tube, said plunger having a bottom end within the tube and a headed end outside the tube, said plunger having opposite L-shaped grooves having a common axial section and opposite tangential sections;

a biasing means inside the tube and between the closed end of the tub and the bottom end of the plunger; and a locking pin secured in the engagement means in the inner wall of the tube, said locking pin traveling through the L-shaped grooves of the plunger, wherein the plunger is able to travel laterally in the tube when the locking pin is disposed in the axial section of the L-shaped grooves and unable to travel laterally in the tube when the plunger has been rotated to place the locking pin in the opposing tangential sections of the L-shaped grooves.

8. The tension assembly of claim 7, further comprising a foot member coupled to the headed end of the plunger.

9. The tension assembly of claim 7, wherein said biasing means is selected from the group consisting of a helical coil spring, a leaf spring, and an elastic cushion.

10. The tension assembly of claim 7, wherein the tension assembly is configured such that rotation of the plunger disengages the locking pin from the opposite tangential sections of the L-shaped grooves and allows expansion of the biasing means.

11. A load-supporting rod assembly configured to engage opposing surfaces, the rod assembly comprising:

a rod having a first end and a second end;

a cavity extending within the rod from the first end of the rod; and a tension assembly disposed within the cavity, said tension assembly comprising a tube having a cylindrical inner wall, a closed end and an open end, wherein the closed end is disposed toward the first end of the first rod portion and the open end is disposed toward the second end of the first rod portion, said tube comprising engagement means in the inner wall and a protruding lip about the diameter of the open end, said protruding lip having a diameter that is at least as great as the outer diameter defined by the first rod portion;

a plunger slidably disposed within the inner wall of the tube, said plunger having a bottom end within the tube and a headed end outside the tube, said plunger having opposite L-shaped grooves having a common axial section and opposite tangential sections;

a biasing means inside the tube and between the closed end of the tub and the bottom end of the plunger; and a locking pin secured in the engagement means in the inner wall of the tube, said locking pin traveling through the L-shaped grooves of the plunger, wherein the plunger is able to travel laterally in the tube when the locking pin is disposed in the axial section of the L-shaped grooves and unable to travel laterally in the tube when the plunger has been rotated to place the locking pin in the opposing tangential sections of the L-shaped grooves.

12. The load-supporting rod assembly of claim 11, further comprising a foot member coupled to the headed end of the plunger, wherein the foot member is configured to engage an opposing surface.

13. The load-supporting rod assembly of claim 11, wherein said biasing means is selected from the group consisting of a helical coil spring, a leaf spring, and an elastic cushion.

14. The load-supporting rod assembly of claim 11, wherein the tension assembly is secured in the cavity by a crimping of the rod.

15. The load-supporting rod assembly of claim 1, wherein the tension assembly is configured such that rotation of the plunger disengages the locking pin from the opposite tangential sections of the L-shaped grooves and allows expansion of the biasing means.

* * * * *